US007461844B1

(12) United States Patent
DeVor

(10) Patent No.: US 7,461,844 B1
(45) Date of Patent: Dec. 9, 2008

(54) "YOU OUGHT TO REMEMBER" BOARD GAME

(76) Inventor: Holly A DeVor, 6268 Fieldstone Trail, Seven Hills, OH (US) 44131

( * ) Notice: Subject to any disclaimer, the term of this patent is extended or adjusted under 35 U.S.C. 154(b) by 42 days.

(21) Appl. No.: 11/800,762

(22) Filed: May 7, 2007

(51) Int. Cl.
*A63F 3/00* (2006.01)

(52) U.S. Cl. ..... 273/249; 273/243

(58) Field of Classification Search ..... 273/236, 273/243, 249; D21/350, 351
See application file for complete search history.

(56) References Cited

U.S. PATENT DOCUMENTS

| | | | |
|---|---|---|---|
| D273,402 | S | 4/1984 | Adkins |
| 5,083,794 | A | 1/1992 | Santagata |
| 5,660,389 | A | 8/1997 | Freda, III |
| 5,735,522 | A | 4/1998 | Sausa |
| 6,752,393 | B2 | 6/2004 | DiGirolamo et al. |
| 2003/0052456 | A1 | 3/2003 | Lasko et al. |

*Primary Examiner*—Vishu K. Mendiratta

(57) ABSTRACT

The invention is a trivia board game in which each player attempts to answer trivia questions in order to advance on the board. Each player retains his or her game piece by designating their year of birth, which translates over to the Chinese zodiac animal involving the Rat, Ox, Tiger, Rabbit, Dragon, Snake, Horse, Ram, Monkey, Rooster, Dog, and Pig. The first player rolls both dice, while the player to the right picks up a card, announces the year, and reads the question from the corresponding color category designated on the dice. The person being asked the questions has two minutes to respond correctly in order to advance. Once the time runs out, the player reading the question, yells "ALL PLAY!", which enables all of the players, excluding the reading player, from answering the question and advancing on the game board. If a player lands on a "You Ought To Remember" space, he or she must respond to a trivia question from a "You Ought To Remember" card designated by rolling the numbered die. The game progresses through all of the players in the same fashion until a player reaches the end of the game board, at which point he or she has won the game.

2 Claims, 6 Drawing Sheets

"YOU OUGHT TO REMEMBER" BOARD GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to a trivia board game.

B. Prior Art

The Sausa Patent (U.S. Pat. No. 5,735,522) discloses a quote and year trivia question game including a game board, die, a plurality of game pieces, and a plurality of cards. This patent does not utilize a board game in which the path the players follows resembles a dragon, nor does it utilize the Chinese year system to determine the game pieces the payers used.

The Freda III Patent (U.S. Pat. No. 5,660,389) discloses a history-based trivia game wherein the answers to all questions are given in the form of a calendar year; game components include a game board, throwing die, game pieces, playing cards, and bonus markers. However, this game utilizes a different scoring system that requires the player to advance their game piece across a calendar year, as opposed to advancing a game piece designated by the year of birth around a dragon design on the game board.

The Lasko et al. Patent Application Publication (U.S. Pub. No. 2005/0052456) discloses a trivia game and method of play including a timer and a plurality of trivia cards. However, this game requires the player to identify specific quotations and other facts surrounding the same on a game board that does not have a beginning or an end.

The DiGirolamo et al. Patent (U.S. Pat. No. 6,752,393) discloses a game board for playing a game of chances and trivia, which includes at least one set of valued question/answer cards. Again, this game does not utilize a game board that has a path resembling a dragon with a beginning and an end.

The Santagata Patent (U.S. Pat. No. 5,083,794) discloses a trivia game which includes a game board. However, this game has a game board that begins on a specified date in history and follows along to the end that is at another specified point of history, which does not resemble a dragon.

The Adkins Patent (U.S. Pat. No. Des. 273,402) illustrates a design for a game board.

BRIEF SUMMARY OF THE INVENTION

The invention is a trivia board game in which each player attempts to answer trivia questions in order to advance on the board. Each player retains his or her game piece by designating their year of birth, which translates over to the Chinese zodiac animal involving the Rat, Ox, Tiger, Rabbit, Dragon, Snake, Horse, Ram, Monkey, Rooster, Dog, and Pig. The first player rolls both dice, while the player to the right picks up a card, announces the year, and reads the question from the corresponding color category designated on the dice. The person being asked the questions has two minutes to respond correctly in order to advance. Once the time runs out, the player reading the question, yells "ALL PLAY!," which enables all of the players, excluding the reading player, from answering the question and advancing on the game board. If a player lands on a "You Ought To Remember" space, he or she must respond to a trivia question from a "You Ought To Remember" card designated by rolling the numbered die. The game progresses through all of the players in the same fashion until a player reaches the end of the game board, at which point he or she has won the game.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
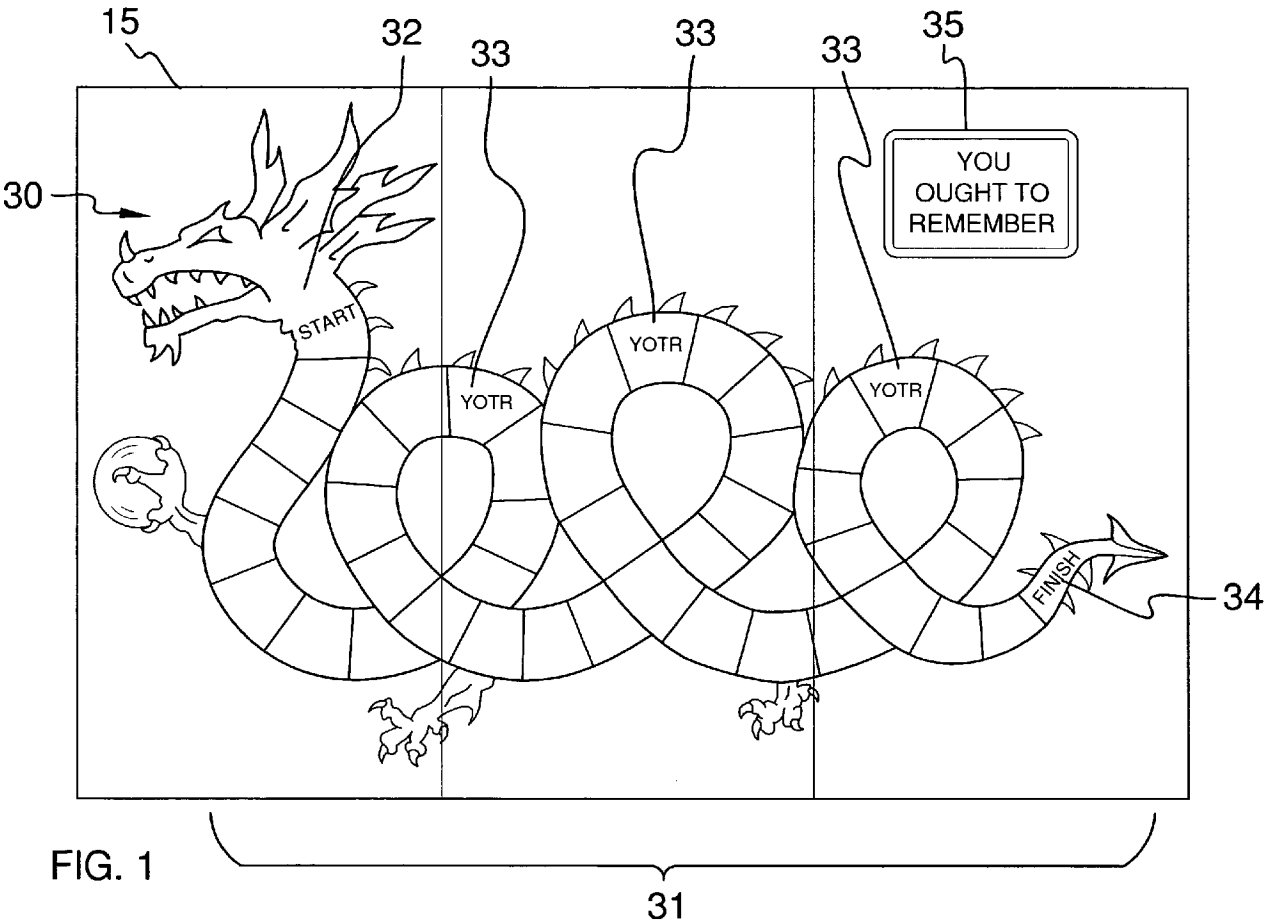
FIG. 1 illustrates the layout of the board game.
Figure 2:
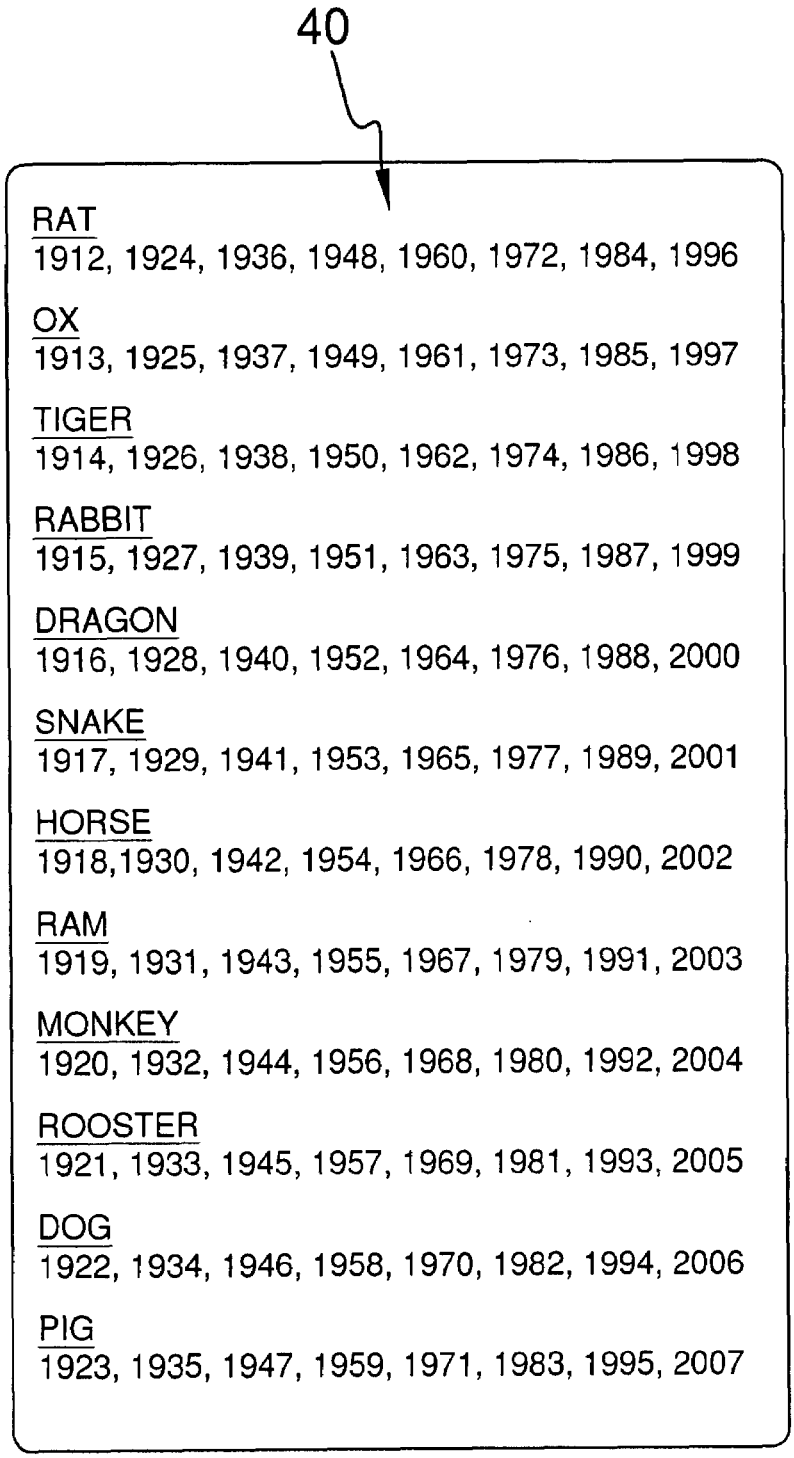
FIG. 2 illustrates a chart of the birth year and corresponding animal designated under the Chinese calendar.
Figure 3:
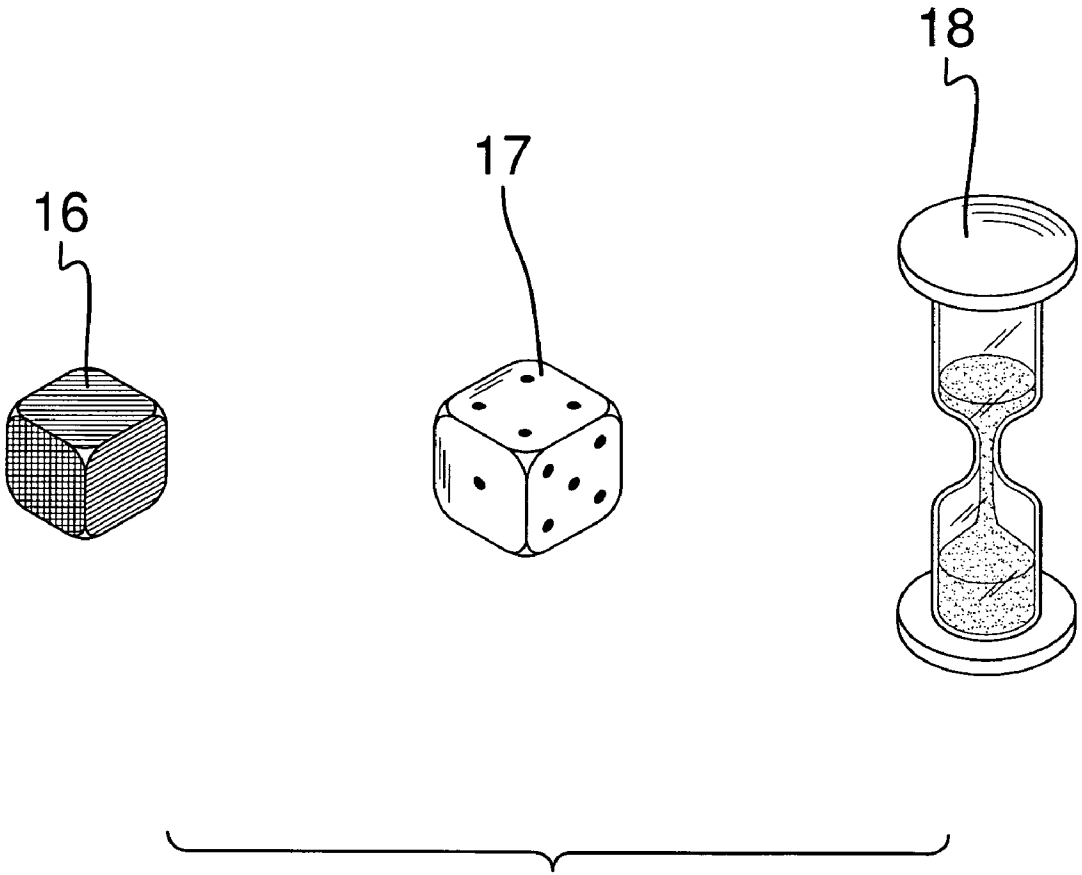
FIG. 3 illustrates the color die, the numbered die, and the timer.
Figure 4:
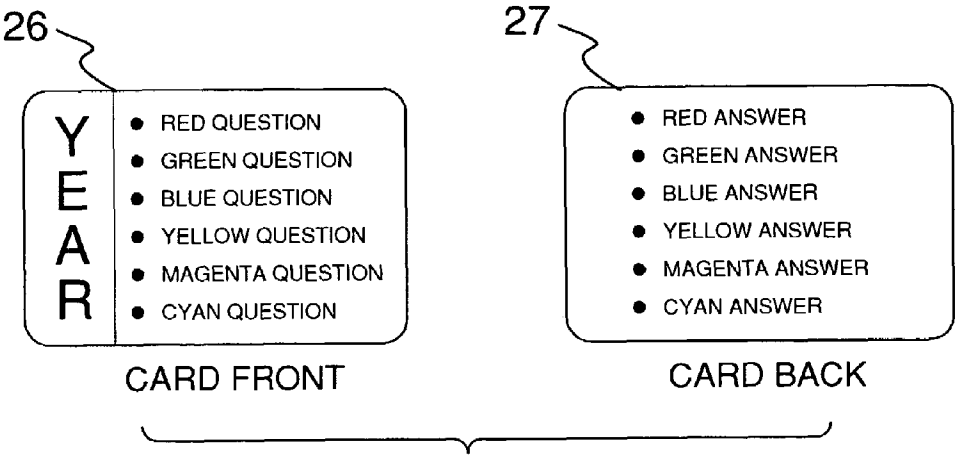
FIG. 4 illustrates the top and bottom side of the trivia card.
Figure 5:
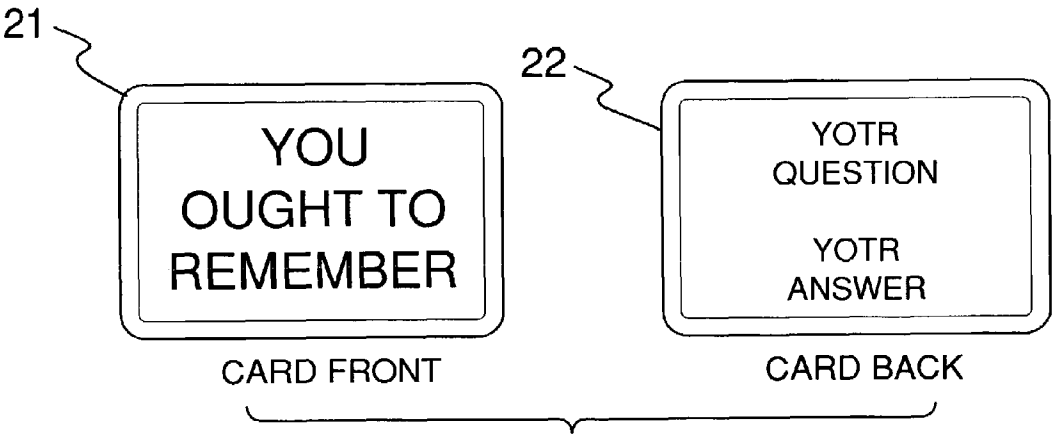
FIG. 5 illustrates the top and bottom side of the "You Ought To Remember" card.
Figure 6:
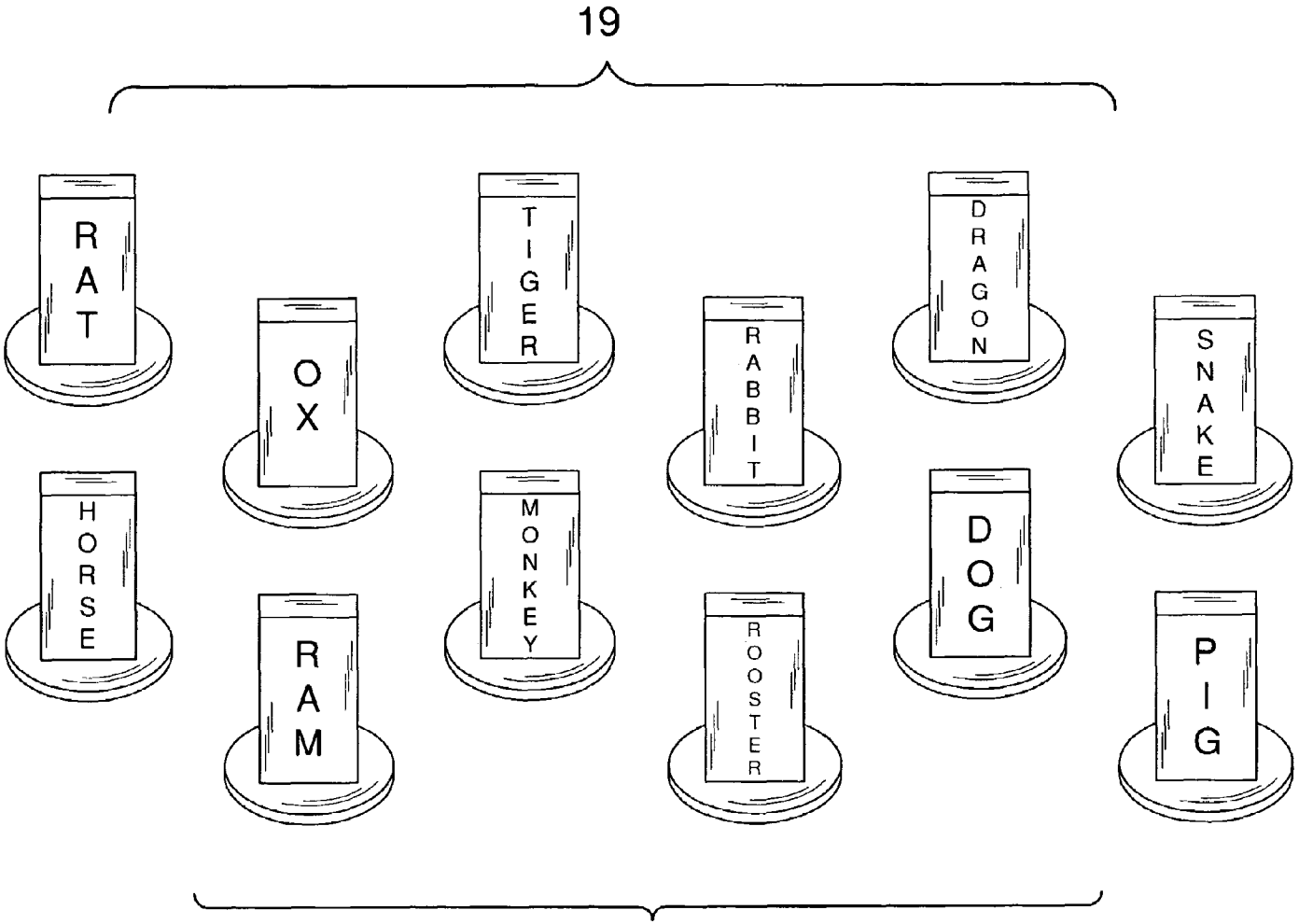
FIG. 6 illustrates the various player pieces with the corresponding Chinese zodiac animal.
Figure 7:
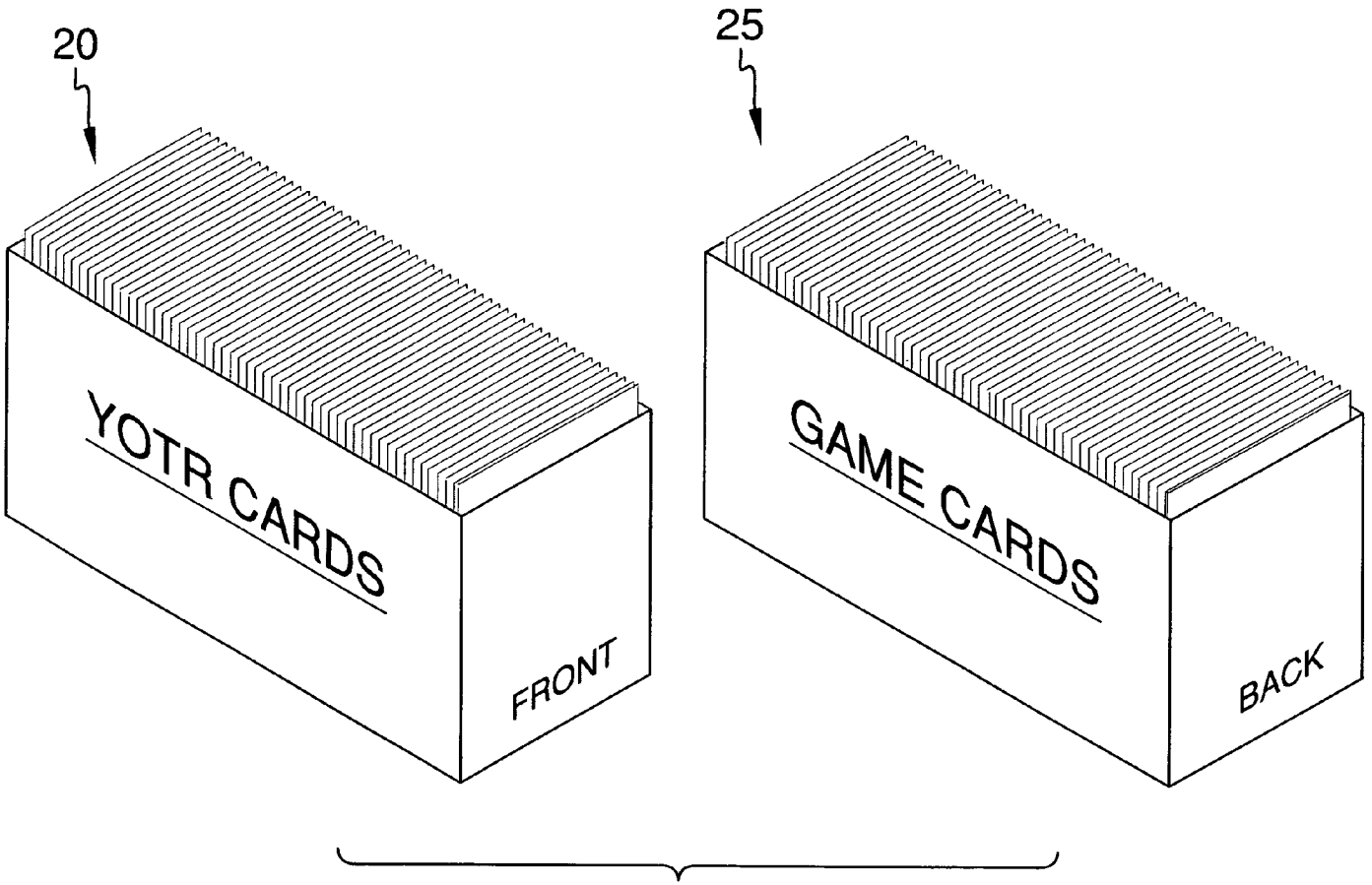
FIG. 7 illustrates the box of "You Ought To Remember" cards as well as the box of game cards.

Detailed reference will now be made to the preferred embodiments of the present invention, examples of which are illustrated in FIGS. 1-7. The invention 10 comprises a board game 15, a colored die 16, a numbered die 17, a timer 18, a set of playing pieces 19, a box of "You Ought To Remember" cards (hereinafter YOTR) 20, and a box of game cards 25.

The board game 15 has a depiction of a Chinese dragon 30 on the center. The Chinese dragon 30 has a plurality of spaces 31 drawn throughout the body of the Chinese dragon 30. Out of the spaces 31, is a start space 32, a plurality of "You Ought To Remember" spaces (hereinafter YOTR) 33, and a finish space 34. Located on the board game 15 is a designated spot 35 to place the box of YOTR cards 20.

There is a specified quantity of playing pieces 19 to include one for each of the Chinese Zodiac animals. As previously mentioned, each player picks a playing piece 19 according to his or her year of birth. However, whenever there are two or more players who have the same year of birth, the oldest of whom is given the Chinese zodiac animal, and the other(s) must select from the remaining zodiac animal. A zodiac calendar 40 is provided to enable each of the players to determine his or her respective zodiac animal.

To determine which player begins the game, all of the players must roll the die in which the highest roll designates the first player to begin the game. If two or more players roll the same number, then those players continue to roll amongst each other until an order for said players is designated. All of the players place their playing piece 19 on the start space 32.

The first player begins by rolling both the numbered die 17 and the colored die 16, after which the player to the right of the roller selects the first card from the game cards box 25 and reads the year from the card front 16. Said reader then reads the question from the category that corresponds to the color on the colored die 16.

As the question is read, the timer 18 is flipped and the period of 2 minutes begins to elapse. If the first player answers the question correctly within 2 minutes, he or she moves the number of spaces designated on the numbered die 17. If the roller is unable to correctly answer the question, he or she must remain on his or her current space. The player continues his turn until he or she is unable to correctly answer the question. Though, on his or her next turn, he or she rolls only the colored die to select the category, answer the corresponding question, and continue on as before.

Should the time remaining on the timer 18 run out, the player reading the question will announce "ALL PLAY," which enables all players, excluding the reader, to shout out the correct answer. The player who correctly answers the question first gets to move his or her playing piece 19 the number of spaces 31 designated on the numbered die 17. However, this player does not gain control over the dice, but instead passes to the next player in turn.

If a player lands on one of the YOTR spaces 33, the player to the right shall pull a YOTR card 20. The player will then roll the numbered die 17 to indicate which question will be read from the card front 21. If the question is answered correctly, the player moves his or her playing piece 19 the number of spaces indicated on the numbered die 17. The player will then continue playing the game with both the colored die 16 and the numbered die 17. However, should the player not answer the question correctly, he or she will then have to remain on the YOTR space 33, while all play rules remain in effect.

If there should ever arise a situation during an "ALL PLAY" in which there is a challenge as to who out of the two players who first answered the question correctly, a roll of the numbered die 17 will resolve the dispute as between the two players. If more than 2 players are on the same space 31, an "ALL PLAY" is in effect for those players. The winner may either move forward the corresponding number of spaces designated by the numbered die 17, or choose to send his opponent back said numbered of spaces. If none of the players answers the question correctly in the allotted time, the roller's turn is over, and both the colored die 16 and the numbered die 17 are passed to the next player in turn.

The player must land on the finish square 34, but the roll on the numbered die 17 need not be exact. The player must answer the question correctly on the card front 26 in order to win the game.

The inventor claims:

1. A trivia board game comprising:

(a) a board game;

wherein the board game has a depiction of a Chinese dragon;

wherein the Chinese dragon has a plurality of spaces drawn throughout the body;

wherein out of the spaces, is a start space, a plurality of "You Ought To Remember" spaces (hereinafter YOTR), and a finish space;

wherein located on the board game is a designated spot to place a box of YOTR cards;

(b) a colored die;

(c) a numbered die;

(d) a timer;

wherein the timer is set to run for a period not to exceed 5 minutes and not to precede 1 minute;

(e) a set of playing pieces corresponding to the Chinese zodiac animals, including but not limited to a rat, an ox, a tiger, a rabbit, a dragon, a snake, a horse, a ram, a monkey, a rooster, a dog, and a pig;

(f) the box of "You Ought To Remember Cards" (hereinafter YOTR);

wherein the front side of the YOTR card has "YOU OUGHT TO REMEMBER" written on it;

wherein the back side of the YOTR card has the a YOTR question and a YOTR answer;

(g) a box of game cards; and wherein the front side of the game card has a year designated to the left, and a series of trivia questions corresponding to each one of six colors located on the colored die;

wherein the back side of the game card has the answer to each colored question listed on the front side of the game card;

(h) a zodiac calendar is provided to enable each of the players to determine his or her respective zodiac animal; and wherein a zodiac calendar listing the Chinese zodiac animal and corresponding year starting from 1885.

2. The trivia board game as described in claim 1 wherein the rules of playing the game are as follows:

(a) to determine which player begins the game, all of the players must roll the die in which the highest roll designates the first player to begin the game;

if two or more players roll the same number, then those players continue to roll amongst each other until an order for said players is designated;

all of the players place their playing piece 19 on the start space;

(b) the first player begins by rolling both the numbered die and the colored die, after which the player to the right of the roller selects the first card from the game cards box and reads the year from the card front;

wherein said reader then reads the question from the category that corresponds to the color on the colored die;

wherein as the question is read, the timer is flipped and the designated period of time begins to elapse;

wherein if the first player answers the question correctly within the time period, he or she moves the number of spaces designated on the numbered die;

wherein if the roller is unable to correctly answer the question, he or she must remain on his or her current space;

wherein the player continues his turn until he or she is unable to correctly answer the question; though, on his or her next turn, he or she rolls only the colored die to select the category, answer the corresponding question, and continue on as before;

(c) should the designated time remaining run out, the player reading the question will announce "ALL PLAY," which enables all players, excluding the reader, to shout out the correct answer;

the player who correctly answers the question first gets to move his or her playing piece the number of spaces designated on the numbered die;

however, this player does not gain control over the dice, but instead passes to the next player in turn;

(d) if a player lands on one of the YOTR spaces, the player to the right shall pull a YOTR card;

the player will then roll the numbered die to indicate which question will be read from the card front;

if the question is answered correctly, the player moves his or her playing piece the number of spaces indicated on the numbered die;

the player will then continue playing the game with both the colored die and the numbered die; however, should the player not answer the question correctly, he or she will then have to remain on the YOTR space, while all play rules remain in effect;

(e) if there should ever arise a situation during an "ALL PLAY" in which there is a challenge as to who out of the two players who first answered the question correctly, a roll of the numbered die will resolve the dispute as between the two players;

if more than 2 players are on the same space, on "ALL PLAY" is in effect for those players; the winner may either move forward the corresponding number of spaces designated by the numbered die, or choose to send his opponent back said numbered of spaces; if none of the players answers the question correctly in the allotted time, the roller's turn is over, and both the colored die and the numbered die are passed to the next player in turn; and (f) the player must land on the finish square, but the roll on the numbered die need not be exact; and the player must answer the question correctly on the card front in order to win the game.

* * * * *